US006716079B2

(12) United States Patent
Jin et al.

(10) Patent No.: US 6,716,079 B2
(45) Date of Patent: Apr. 6, 2004

(54) FIELD EMISSION DISPLAY AND JUNCTION METHOD OF SPACER IN THE SAME

(75) Inventors: Il Sup Jin, Seoul (KR); Young Hwan Song, Gwachun-si (KR)

(73) Assignee: LG Electronics Inc., Seoul (KR)

( * ) Notice: Subject to any disclaimer, the term of this patent is extended or adjusted under 35 U.S.C. 154(b) by 39 days.

(21) Appl. No.: 10/034,460

(22) Filed: Dec. 28, 2001

(65) Prior Publication Data

US 2002/0086604 A1 Jul. 4, 2002

(30) Foreign Application Priority Data

Dec. 29, 2000 (KR) ..... 2000-84995

(51) Int. Cl.[7] ..... H01J 9/24
(52) U.S. Cl. ..... 445/24; 313/496
(58) Field of Search ..... 445/24, 25; 313/425, 313/446, 497, 242

(56) References Cited

U.S. PATENT DOCUMENTS 6,152,796 A * 11/2000 Nakata ..... 445/24
6,554,671 B1 * 4/2003 Hofmann et al. ..... 445/24
2001/0009836 A1 * 7/2001 Kakanishi et al. ..... 445/24

* cited by examiner

*Primary Examiner*—P. Austin Bradley
*Assistant Examiner*—Briggitte R. Hammond
(74) *Attorney, Agent, or Firm*—Lee, Hong, Degerman, Kang & Schmadeka

(57) ABSTRACT

The present invention discloses a junction method of a spacer in a field emission display. An adhesive strength between a spacer and an anode substrate is improved by preventing the spacer from being separated due to separation of a metal-back thin film, by printing a frit at the lower portion of the metal-back thin film. Moreover, the metal-back thin film is deposited on the frit, thereby preventing surface charge accumulation or arcing due to electron collision during the driving of the field emission display.

10 Claims, 5 Drawing Sheets

Fig. 1 - Related Art
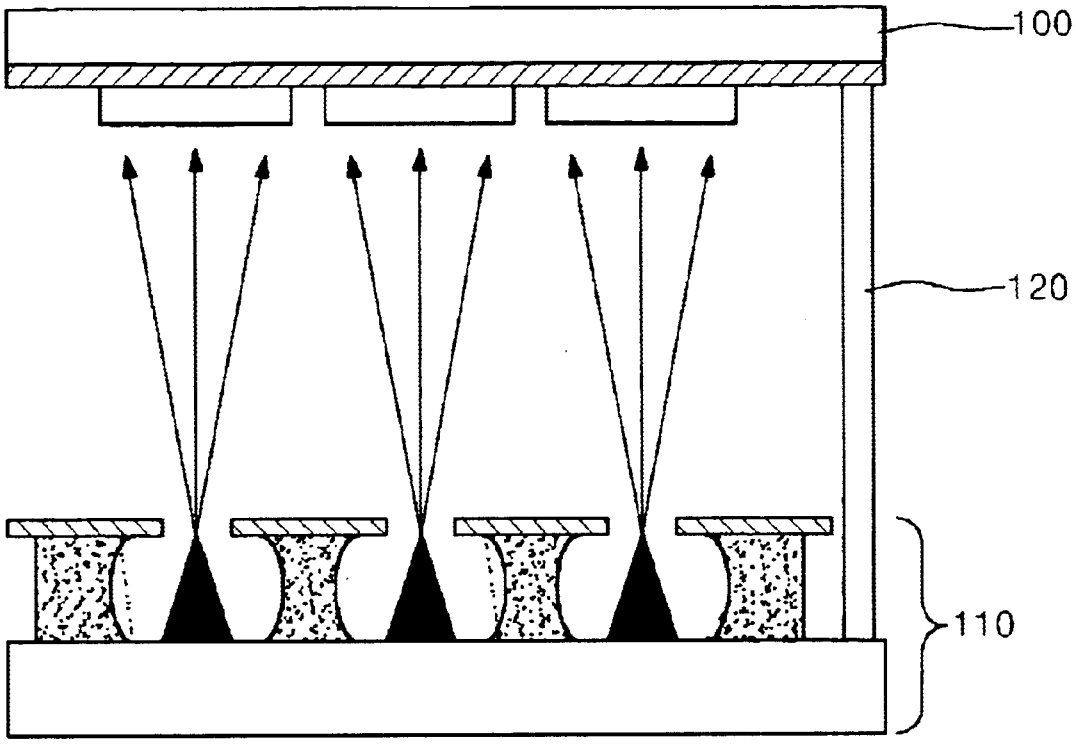

Fig. 2A - Related Art
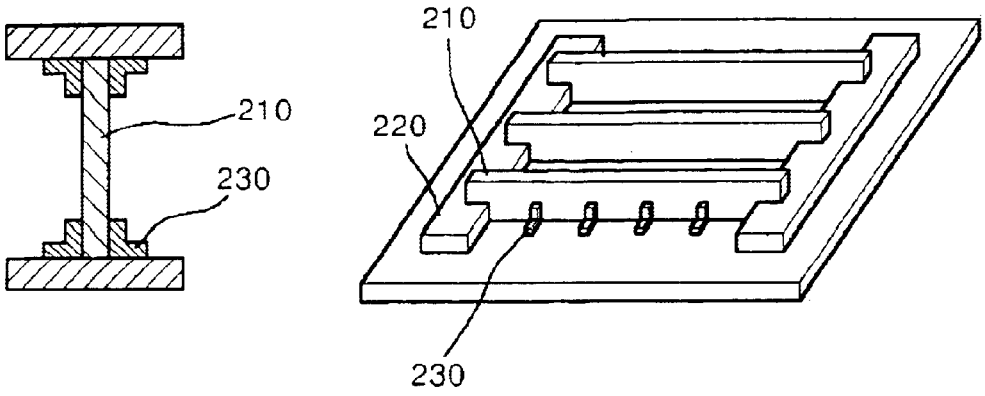
Fig. 2B - Related Art
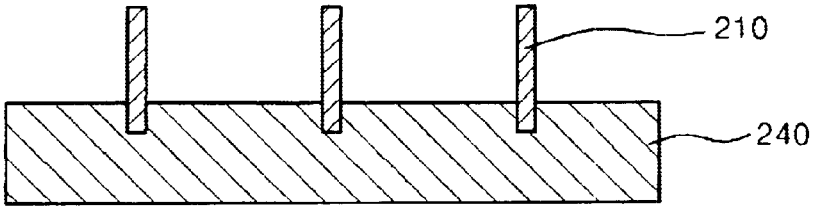
Fig. 2C - Related Art
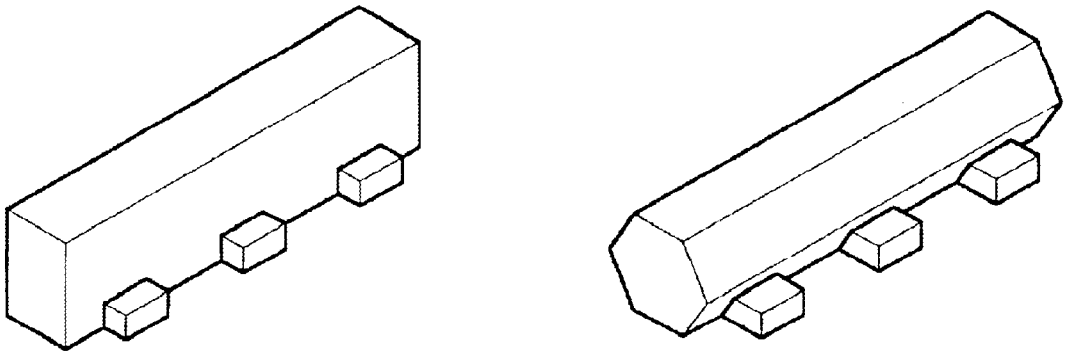

FIELD EMISSION DISPLAY AND JUNCTION METHOD OF SPACER IN THE SAME

BACKGROUND OF THE INVENTION

1. Field of the Invention

The present invention relates to junction of a spacer of a field emission display, and in particular to a junction method of a spacer in a field emission display, and the field emission display which can enhance an adhesive strength between a spacer and an anode substrate, and overcome the charging and arcing problem of electrons due to collision of the electrons and a frit material, by printing the frit before depositing a metal-back thin film.

2. Description of the Related Art

Recently, a field emission display (FED) has been actively developed. The FED provides excellent image quality like a cathode ray tube even in a thin film structure such as a liquid crystal display (LCD) or plasma display panel (PDP).

FIG. 1 is a diagram illustrating a structure of a general FED.

Referring to FIG. 1, the FED includes: an anode substrate 100; a cathode substrate 110; and a spacer 120 for supporting a vacuum gap between the two substrates.

The FED is divided into a low voltage type FED and a high voltage type FED.

The low voltage type FED is driven by applying a low anode voltage of 400 to 1000V to an anode electrode. The low voltage type FED has advantages in that the spacer for maintaining the vacuum gap can be easily designed and formed, and that a material can he flexibly selected. However, light emission efficiency of a currently-used low voltage fluorescent material is low. and concentration of electrons is not active.

In order to solve the foregoing problems, there has been suggested the high voltage type FED. Advantageously, the high voltage type FED can employ a general fluorescent material for a cathode ray tube operated at a high voltage as it is.

Conversely, as compared with the low voltage type FED, a high voltage (1 kV to 10 kV) should be applied to the anode substrate 100 for concentration of an electron beam. Accordingly, the anode substrate 100 and the cathode substrate 110 maintain an interval of at least 1 mm due to application of the high voltage.

An aspect ratio of the spacer structure is increased over 1:20 to satisfy such an additional limit condition. It is thus difficult to precisely align the spacer 120 between the pixels due to the high aspect ratio of the spacer.

In order to overcome such difficulties, there have been suggested methods for forming a spacer in various shapes.

For example, suggested are a method for aligning a rib type spacer by using an auxiliary grip, and a method for precisely forming a groove on an anode substrate and inserting a spacer into the groove. In addition, there is a method for processing a spacer in various shapes by using a photoresist glass.

FIGS. 2A to 2C are diagrams illustrating a conventional junction method of a spacer.

FIG. 2A shows a method for aligning a rip type spacer 210 by using an auxiliary ceramic grip 220 and a polyimide grip 230.

FIG. 2B shows a method for precisely forming a groove on a cathode substrate 240, and inserting the rip type spacer 210 into the groove.

FIG. 2C shows a method for processing the spacer in various shapes by using the photoresist glass.

In the aforementioned methods, the auxiliary grips 220 and 230 prevent vacuum exhaust, or a complicated process is added for spacer processing or junction. Furthermore, application technologies of the methods are also difficult.

In order to overcome such technical difficulties, there is suggested a method for printing a junction material such as a frit glass on the anode substrate or cathode substrate, and aligning and holding the spacer, without using the auxiliary grips 220 and 230. Especially in the junction method which the junction material is used, the spacer is bonded to the anode substrate to prevent the cathode substrate from being damaged due to a post heat process.

During the process of the anode substrate, a metal-back thin film is deposited on emulsion, and then the emulsion is removed to planarize the surface. Generally, the emulsion is removed according to a heat process. However, the metal-back material comes off the upper portion of the anode substrate by the emulsion removing process, and thus has a very low adhesive strength.

That is, when the frit for the junction of the spacer is printed on the metal-back thin film, the adhesive property of the metal-back thin film is deteriorated. As a result, the adhesive strength of the spacer is also reduced.

SUMMARY OF THE INVENTION

It is, therefore, an object of the present invention to provide a junction method of a spacer in a field emission display for preventing charging and arching of electrons by printing a frit before depositing a metal-back thin film.

To achieve the above object, there is provided a junction method of a spacer in a field emission display including the steps of: forming a fluorescent material on an anode substrate; coating emulsion which is a planarization layer thereon; forming a frit at a predetermined position on the emulsion; depositing a metal-back thin film thereon; and aligning and bonding the spacer on the anode substrate.

In another aspect of the present invention, in the process for forming the fluorescent material, a black matrix is formed by patterning the fluorescent material on the substrate, the frit is printed on the black matrix, and a binder included in the frit is removed according to a heat process.

In a yet another aspect of the present invention, the metal-back thin film is planarized, the emulsion is removed, and preliminary sintering of the frit is performed at the same time, by executing a heat process after depositing the metal-back thin film.

In a yet another aspect of the present invention, in the step for aligning and bonding the spacer, the spacer is aligned on the frit area, and bonded thereto according to a heat process.

In a yet another object of the present invention, there is provided a junction method of a spacer in a field emission display including the steps of: forming a fluorescent material on an anode substrate; forming a frit at a predetermined position on the fluorescent material; coating emulsion which is a planarization layer on the fluorescent material; depositing a metal-back thin film on the emulsion; and aligning and bonding the spacer on the anode substrate.

BRIEF DESCRIPTION OF THE DRAWINGS

The above objects, features and advantages of the present invention will become more apparent from the following detailed description when taken in conjunction with the accompanying drawings, in which:

FIG. 1 is a diagram illustrating a general FED;

FIGS. 2A to 2C are diagrams illustrating a conventional junction method for a spacer;

DETAILED DESCRIPTION OF THE PREFERRED EMBODIMENT

Figure 3A:
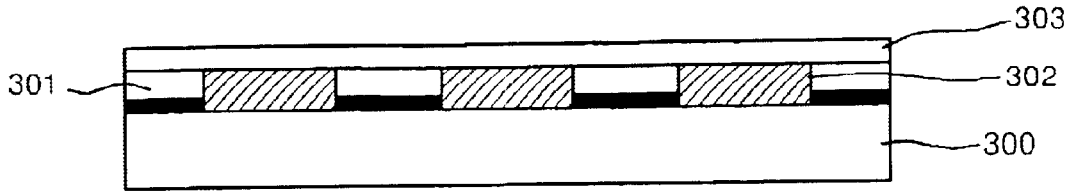
FIGS. 3A to 3E are diagrams illustrating a junction method for a spacer of an FED in accordance with the present invention.

A preferred embodiment of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

FIGS. 3A to 3E are diagrams illustrating a junction method of a spacer in a field emission display (FED) in accordance with the present invention.

As illustrated in FIGS. 3A to 3E, general processes are used as the processes for manufacturing of a black matrix and fluorescent material in the manufacturing process of an anode panel. Therefore, emulsion 303 is coated to planarize a fluorescent material 302 (FIG. 3A).

Figure 3B:
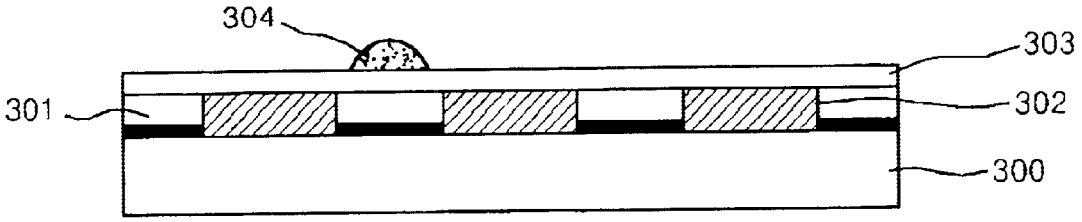

A frit 304 is printed after coating the emulsion 303 (FIG. 3B). The frit 304 is printed with an appropriate pattern by considering a presumed spacer junction area. Here, the frit 304 is printed on a black matrix area.

Figure 3C:
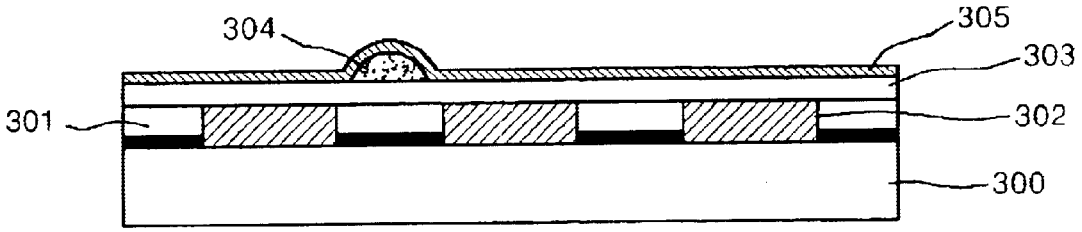

The printed frit 304 is heated in an oven to remove a binder included in a frit paste, and a metal-back thin film 300 is deposited thereon (FIG. 3C).

Figure 3D:
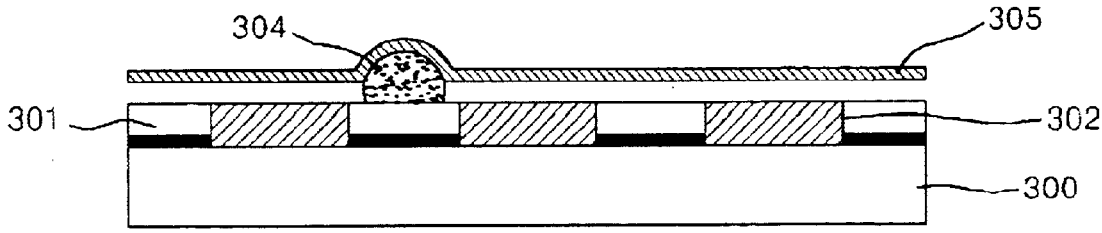

After depositing the metal-back thin film 305. The printed frit 304 is put in a furnace and heated at an appropriate temperature to remove the emulsion 303, thereby simultaneously planarizing the metal thin film, removing the emulsion, and performing a preliminary sintering process of the frit (FIG. 3D).

A spacer 306 is aligned in the frit printed area, and bonded according to a heat process. Thus, the junction method for the spacer is finished (FIG. 3E).

Figure 3E:
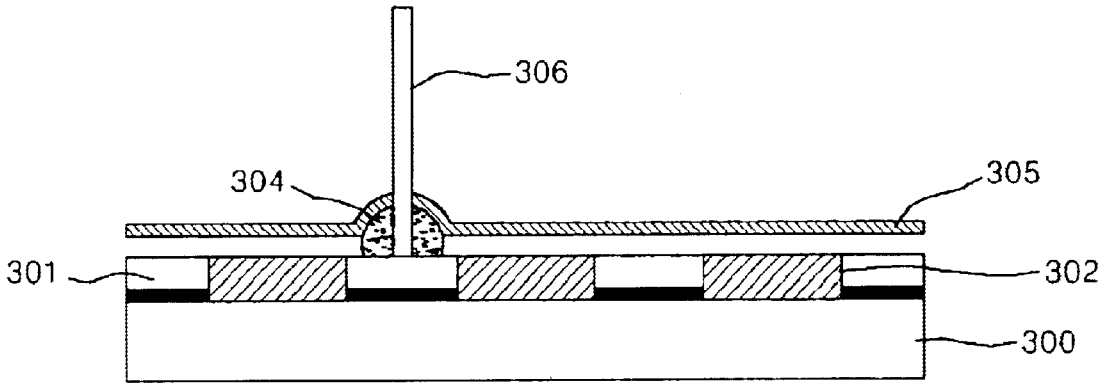

Referring to FIG. 3E, the FED includes: an anode panel 300 having an anode function, the fluorescent material 302 and the black matrix 301 being coated on the inner surface of the FED; a cathode panel (not shown) having a cathode function, and being aligned to face the anode panel 300 at a predetermined interval, a tip for electron emission being formed on the inner surface of the FED; a frit paste 304 positioned on the anode panel 300 for enhancing the junction; and a spacer being fixed to the metal thin film deposited on the frit paste to prevent charging or arcing due to collision of electrons and the frit paste for supporting the anode panel 300 and the cathode panel.

Especially, the metal-back thin film 305 is deposited on the frit paste 304 to prevent charging or arcing of the electrons due to collision of the electrons and the frit paste 304.

On the other hand, in another embodiment of the present invention, the procedure of FIGS. 3A to 3E is repeated but performing the frit process (FIG. 3B) before the emulsion coating process (FIG. 3A).

Although the frit process (FIG. 3B) is performed before the emulsion coating process (FIG. 3A) in the spacer junction process, the major effects of the present invention such as the firm junction of the spacer and prevention of the charging and arcing of the electrons are achieved.

In addition, the spacer can be boned to the cathode panel in the same manner.

Figure 4A:
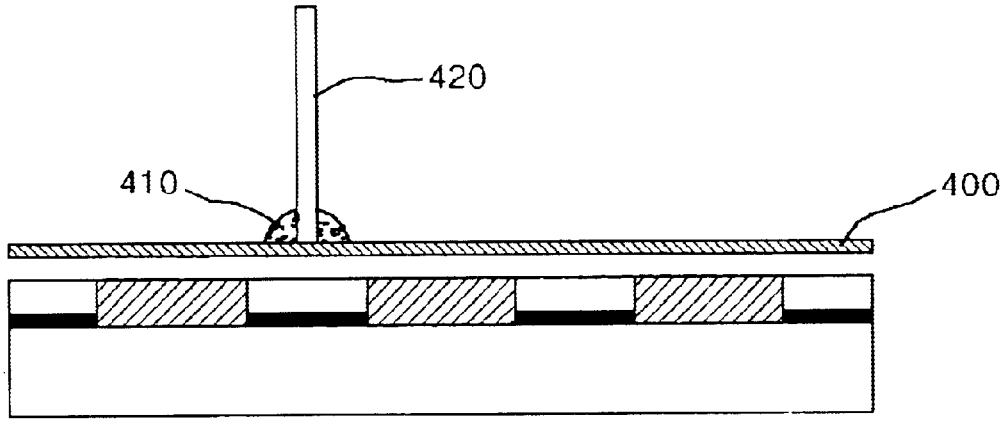
FIGS. 4A and 4B are diagrams illustrating a sectional structure of the conventional spacer junction and a sectional structure of the spacer junction in accordance with the present invention.
Figure 4B:
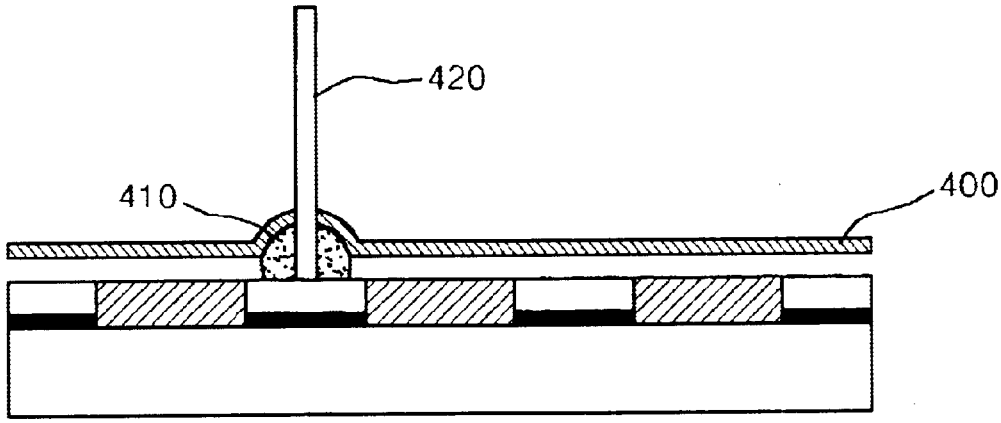

FIGS. 4A and 4B are diagrams illustrating a sectional structure of the conventional spacer junction and a sectional structure of the spacer junction in accordance with the present invention.

As shown in FIG. 4A, the junction structure of the conventional spacer includes: a metal-back thin film 400; a frit 410 formed on the metal-back thin film 400; and a spacer 420 bonded on the frit 410.

That is, the frit 410 is deposited on the metal-back thin film 400 after forming the metal-back thin film 400, and the spacer 420 is formed on the frit 410.

Since the spacer 420 is dependently bonded to the metal-back thin film 400 due to the stacked structure of the metal-back thin film 400, the frit 410 and the spacer 420, the spacer junction is also separated if the metal-back thin film 400 is separated.

As depicted in FIG. 4B, the spacer junction structure in accordance with the present invention includes: the frit 410 formed on a fluorescent material and/or the black matrix; the metal thin film 400 formed on the frit 410; and the spacer 420 bonded by the frit 410.

Especially, the frit 410 is positioned at the lower portion of the metal-back thin film 400, and the spacer 420 is bonded by the frit 410. Accordingly, the spacer 420 is not separated due to separation of the metal-back thin film 400.

As discussed earlier, in accordance with the present invention, the adhesive strength between the spacer and the anode substrate is improved by preventing the spacer from being separated due to separation of the metal-back thin film, by printing the frit at the lower portion of the metal-back thin film. Moreover, the metal-back thin film is deposited on the frit, thereby preventing surface, charge accumulation or arcing due to electron collision during the driving of the FED.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A junction method of a spacer in a field emission display, comprising the steps of:

forming a fluorescent material on an anode substrate;

coating emulsion which is a planarization layer on the fluorescent material;

forming a frit at a predetermined position on the emulsion;

depositing a metal-back thin film on the frit; and aligning and bonding the spacer on the anode substrate.

2. The method according to claim 1, wherein the metal-back thin film is planarized, the emulsion is removed, and a preliminary sintering of the frit is performed at the same time, by executing a heat process after depositing the metal-back thin film.

3. The method according to claim 1, wherein, in the step for aligning and bonding the spacer, the spacer is aligned on the frit area and bonded according to a heat process.

4. The method according to claim 1, wherein the fluorescent material is patterned on the substrate and a black matrix is formed in the process for forming the fluorescent material.

5. The method according to claim 4, wherein the frit is printed on the black matrix and a binder included in the bit is removed according to a heat process in the process for forming the fluorescent material.

6. A junction method of a spacer in a field emission display, comprising the steps of:

forming a fluorescent material on an anode substrate;

forming a frit at a predetermined position on the fluorescent material;

coating emulsion which is a planarization layer on the fluorescent material;

depositing a metal-back thin film on the emulsion; and aligning and bonding the spacer on the anode substrate.

7. The method according to claim 6, wherein the metal-back thin film is planarized, the emulsion is removed, and a preliminary sintering of the frit is performed at the same time, by executing a heat process after depositing the metal-back thin film.

8. The method according to claim 6, wherein, in the step for aligning and bonding the spacer, the spacer is aligned on the frit area, and bonded thereto according to a heat process.

9. The method according to claim 6, wherein, in the process for forming the fluorescent material, the fluorescent material is patterned on the substrate, and a black matrix is formed.

10. The method according to claim 9, wherein, in the process for forming the fluorescent material, the fit is printed on the black matrix, and a binder included in the frit is removed according to a heat process.

* * * * *